US006705841B2

(12) United States Patent
Pawelski et al.

(10) Patent No.: US 6,705,841 B2
(45) Date of Patent: Mar. 16, 2004

(54) VARIABLE DISPLACEMENT COMPRESSOR WITH STEPPED SHAFT

(75) Inventors: Thomas Pawelski, Cologne (DE); Brian R. Kelm, Plymouth, MI (US); Douglas Alexander Young, Livonia, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/087,323

(22) Filed: Mar. 1, 2002

(65) Prior Publication Data

US 2003/0165389 A1 Sep. 4, 2003

(51) Int. Cl.[7] ..... F04B 1/26
(52) U.S. Cl. ..... 417/222.1; 91/499
(58) Field of Search ..... 417/222.1, 222.2, 417/269, 53; 92/12.2, 71; 91/499, 505; 123/56.3, 56.4

(56) References Cited

U.S. PATENT DOCUMENTS

| | | | | |
|---|---|---|---|---|
| 2,513,083 A | | 6/1950 | Eckert | 74/60 |
| 4,175,915 A | * | 11/1979 | Black et al. | 417/222 |
| 4,418,586 A | | 12/1983 | Maki et al. | 74/831 |
| 5,127,314 A | * | 7/1992 | Swain | 92/12.2 |
| 5,233,913 A | * | 8/1993 | Muirhead | 92/71 |
| 5,293,810 A | * | 3/1994 | Kimura et al. | 92/12.2 |
| 5,897,298 A | * | 4/1999 | Umemura | 417/222.2 |
| 6,164,252 A | * | 12/2000 | Kuhn et al. | 123/56.3 |
| 6,186,048 B1 | * | 2/2001 | Kimura et al. | 92/71 |
| 6,224,349 B1 | * | 5/2001 | Iwanami et al. | 417/269 |

FOREIGN PATENT DOCUMENTS

| | | |
|---|---|---|
| FR | 842400 | 2/1938 |

* cited by examiner

*Primary Examiner*—Justine R. Yu
*Assistant Examiner*—Han L. Liu
(74) *Attorney, Agent, or Firm*—Brinks Hofer Gilson & Lione

(57) ABSTRACT

A variable displacement piston compressor comprising a housing and a shaft supported within the housing for rotational movement about an axis. The shaft includes a stepped down portion defining a reduced diameter within the shaft. A pin extends generally outward from the shaft and includes a distal end. A sleeve is mounted about the shaft, is slidable along the shaft, and is rotatable with the shaft. The sleeve extends over a portion of the stepped down portion of the shaft and defines a radial gap between the sleeve and the stepped down portion. A swash-ring is supported on the sleeve and is rotatable with the shaft. The swash-ring is pivotably coupled to the distal end of the pin. The swash-ring defines an angle with the axis that is adjustable with respect to the axis. A biasing member engages the sleeve and biases the sleeve along the shaft.

17 Claims, 6 Drawing Sheets

VARIABLE DISPLACEMENT COMPRESSOR WITH STEPPED SHAFT

BACKGROUND OF INVENTION

1. Technical Field of the Invention

The present invention generally relates to a variable displacement compressor having a swash-ring construction. More specifically, the present invention relates to a variable displacement swash-ring compressor having a stepped shaft.

2. Description of the Prior Art

In an automotive vehicle equipped with air conditioning, a compressor is used to pump coolant through the air conditioning system to cool the vehicle. Most often, the compressor is driven by a serpentine belt of the vehicle and, hence, the speed of the compressor is controlled by the speed of the vehicle. In order to provide consistent operation of the air conditioning system, variable displacement compressors have been developed to allow the compressor to provide constant performance at all vehicle speeds. In a variable displacement compressor, higher displacement is necessary when the vehicle is idling or running at low speeds. When the vehicle is running at high speeds, the compressor is cycling much more rapidly, and therefore can provide equivalent performance at a lower displacement.

The typical automotive air conditioning compressor uses multiple pistons to pump the coolant through the system. The pistons are driven back and forth within the compressor by a plate or ring that is attached to a rotating shaft. The plate or ring is mounted at an angle relative to the shaft and engages each of the pistons. Due to the angle of the ring, radial positions around a periphery of the ring have varying axial positions within the compressor. The pistons are fixed radially within the compressor housing, so that as the shaft and ring rotate the pistons slide along the periphery of the ring and are thereby moved axially back and forth with rotations of the shaft and ring. Variable displacement is achieved by limiting the stroke of the pistons. Variable displacement compressors are available in three basic types: 1) wobble plate compressors, 2) swash-plate compressors, or 3) swash-ring compressors. The present invention is related to a swash-ring compressor.

In a swash-ring compressor, the pistons within the compressor are driven by a swash-ring. Variable displacement, by limiting the stoke of the pistons, is achieved by varying the angle of the swash-ring relative to the rotating shaft. U.S. Pat. No. 6,164,252 describes the construction of a variable displacement swash-ring compressor and is hereby incorporated by reference into the present application.

In the '252 patent, a sleeve is slidably mounted for limited axial movement along the compressor's shaft and a swash-ring is pivotally mounted onto the sleeve. A pin, rigidly mounted within and extending from the shaft, engages the swash-ring at an axial distance from the pivotal connection between the swash-ring and the sleeve. As the sleeve slides along the shaft, the swash-ring moves axially with the sleeve at the pivotal connection, but cannot move axially at the point where the pin engages the swash-ring. This causes the swash-ring to pivot about the point where the pin engages the swash-ring, thereby changing the angle of the swash-ring relative to the shaft.

As a result of the pin transferring rotation to the swash-ring, the pin undergoes very high stresses that require the diameter of the shaft to be large enough to provide sufficient strength to support the pin. Specifically, the shaft is provided with a constant diameter over the entire length along which the sleeve slides. This makes the shaft very heavy and forces other components within the compressor to be designed around the large diameter of the shaft.

As seen from the above, there is a need to improve the design of a shaft for a compressor so that the compressor can be made lighter and more compact.

It is therefore an object of the present invention to provide an improved variable displacement compressor of lighter weight and more compact construction.

A further object of the present invention is to provide a variable displacement compressor having a stepped shaft which will reduce the size and weight of the shaft, as well as allowing other compressor components to be designed smaller and lighter.

SUMMARY OF THE INVENTION

The disadvantages of the prior art are overcome by providing a variable displacement swash-ring compressor with a stepped shaft. Use of the stepped shaft reduces the size and weight of the shaft, and therefore the compressor itself, as well as allowing other compressor components to be designed smaller and lighter.

In one aspect, the present invention is a compressor that includes a shaft rotatably mounted within the compressor. A sleeve is slidably supported on the shaft and includes collar portions, at opposite ends thereof, that support the sleeve on the shaft. A swash-ring is pivotally mounted onto the sleeve such that the swash-ring is angularly adjustable with respect to the shaft. A pin is fixedly mounted to and extends from the shaft and a distal end of the pin pivotally engages the swash-ring. The connection between the swash-ring and the pin forces the swash-ring to rotate with the shaft, while allowing the swash-ring to be angularly adjusted relative to the shaft.

The shaft includes a step adjacent the pin, defining a reduced diameter portion on the shaft and end thereof. By way of this step and reduced diameter portion, an annular gap is formed between the shaft and the inner diameter of the sleeve where the sleeve overlies the reduced diameter portion of the shaft. The annular gap therefore extends along a portion of the sleeve between the first and second collar portions. The sleeve is further biased along the shaft by a spring whose position may be varied.

In another aspect of the present invention, the shaft includes a pair of steps, with each of the steps being located on opposing sides of the pin.

Further variations on the invention include various locations for the spring and for a positive stop for the sleeve. The positive stop can be defined by the step within the shaft, or, the shaft may include a snap ring groove with a snap ring engaged therein to define a positive stop for the sleeve.

DETAILED DESCRIPTION OF THE PREFERRED EMBODIMENTS

Figure 1:
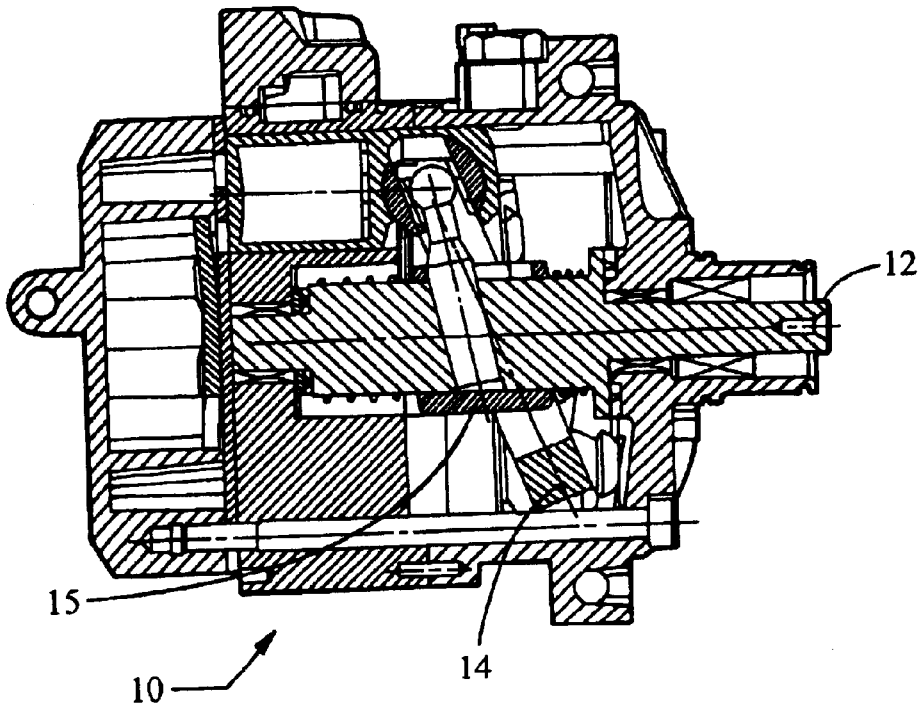
Fig. 1 Prior Art
FIG. 1 is a sectional view of a prior art swash-ring compressor.
Figure 2:
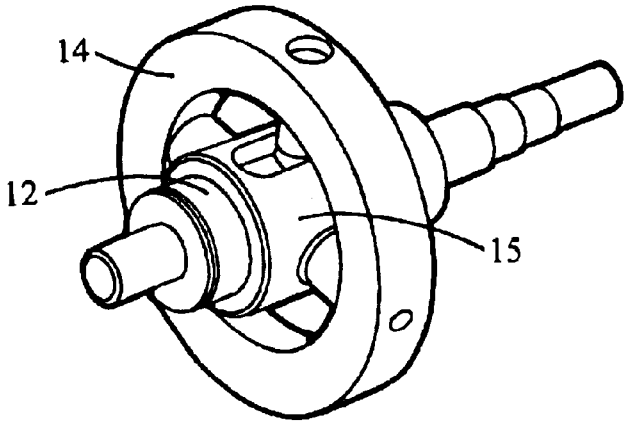
Fig. 2 Prior Art
FIG. 2 is a perspective view of the shaft, swash-ring and sleeve of the compressor of FIG. 1.

Referring to FIGS. 1 and 2, a prior art variable displacement piston compressor is shown therein and generally designated at 10. The variable displacement compressor 10 is a swash-ring type compressor having a rotating driven shaft 12 with a swash-ring 14 supported thereon. A sleeve 15 is slidable along the shaft 12 and is pivotally connected to the swash-ring 14. By sliding the sleeve 15 along the shaft 12, the angle of the swash-ring 14 is varied. A complete description of the variable displacement swash-ring compressor is found in U.S. Pat. No. 6,164,252 which has been incorporated by reference into the present application.

Figure 3:
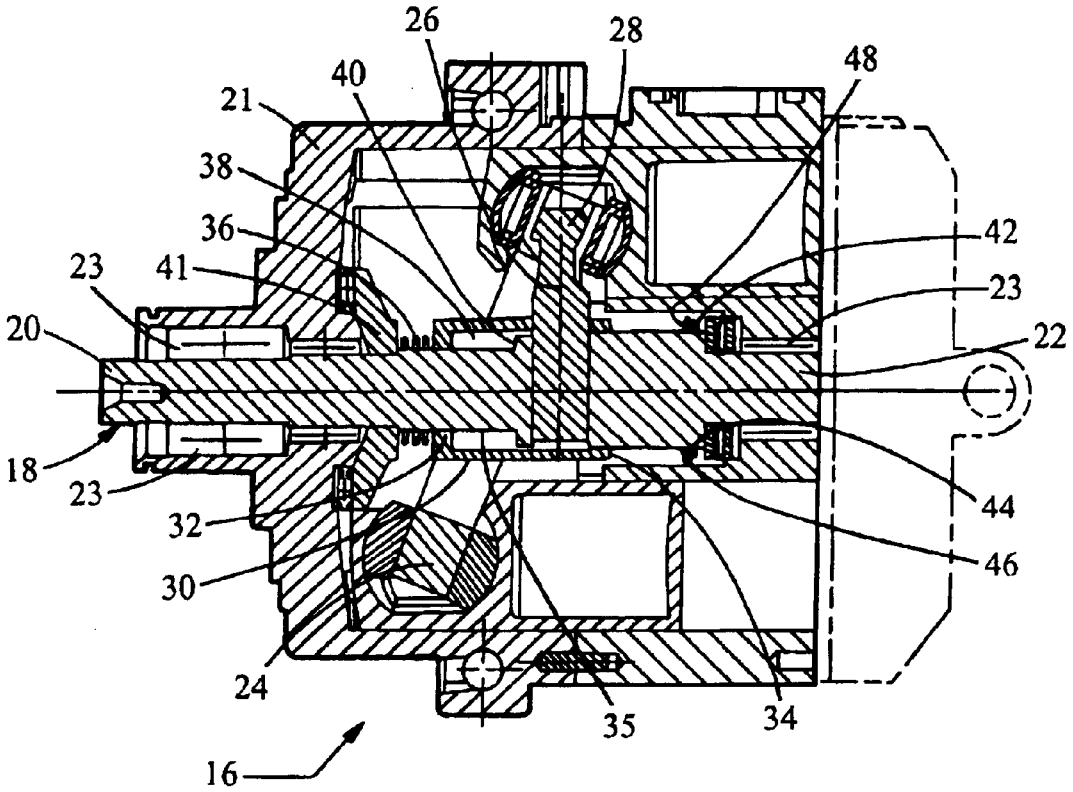
FIG. 3 is a sectional view of a first preferred embodiment of the present invention wherein the shaft includes a single step.

Referring now to FIG. 3, a variable displacement piston compressor of the present invention is shown generally at 16. Just as the compressor 10 shown in FIG. 1, the compressor 16 of the present invention includes a driven shaft 18 having a first end 20 and a second end 22. The first and second ends 20, 22 of the shaft 18 are supported within a compressor housing 21 by bearing elements 23. The shaft 18 is adapted for rotational movement within the compressor housing 21. Typically, the shaft 18 will have a pulley (not shown) mounted to one of the ends 20, 22. The pulley engages a serpentine belt of an automotive vehicle, although, the concepts of the present invention would work on a compressor where the shaft 18 is driven by other means.

A sleeve 30 is slidably supported on the shaft 18 and includes a first collar portion 32 and a second collar portion 34 at opposing ends thereof. The first and second collar portions 32, 34 support the sleeve on the shaft 18. The shaft 18 further includes a stepped profile defining a reduced diameter portion 35. Where the sleeve 30 overlies the reduced diameter portion 35, an annular gap 38 is formed between an inner diameter of the sleeve 30 and the shaft 18. A spring 36 is mounted on the shaft 18 to bias the sleeve 30 along the shaft 18 for adjustment purposes of a swash-ring 24 further discussed below. The spring 36 can be positioned between one of the collar portions 32, 34 of the sleeve 30 and a structural portion of the compressor 16, or the spring 36 can be positioned within the gap 38.

The swash-ring 24 is pivotally mounted onto the sleeve 30. The swash-ring 24 is supported on the sleeve 30 by a pair of bearing pins 31. The bearing pins 31 are axially aligned with one another and extend radially outward from diametrically opposed sides of the sleeve 30. The bearing pins 31 pivotally engage the swash-ring 24 wherein the swash-ring 24 is pivotable about an axis 33 running longitudinally through the bearing pins 31 and through the shaft 18. The pivotal connection between the swash-ring 24 and the sleeve 30 allows the angle of the swash-ring 24 relative to the shaft 18 to be adjusted.

A pin 26 is mounted within and extends from the shaft 18. The swash-ring includes a radially inwardly open pocket 37. A distal end 28 of the pin 26 pivotally engages the radially inwardly open pocket 37 such that the swash-ring 24 is allowed to pivot about the distal end 28 of the pin 26. However, the connection between the distal end 28 of the pin 26 and the swash-ring 24 forces the swash-ring 24 to rotate with the shaft 18.

In one embodiment, the shaft 18 includes a step 40 adjacent to the pin 26 and toward one of the first and second ends 20, 22 of the shaft 18. The step 40 formed within the shaft 18 allows the diameter of the shaft 18 to remain large enough at and near the pin 26 to provide sufficient strength to support the pin 26. The diameter of portions 35 of the shaft 18 not immediately adjacent the pin 26 is reduced, thereby reducing the weight of the shaft 18 and allowing other components, which are designed around the shaft 18, to be made smaller. The advantages of the present invention include lightening the compressor 16 as well as allowing a reduction of the overall size of the compressor 16.

In the first preferred embodiment, seen in FIG. 3, the shaft 18 includes a single step 40 that is adjacent the pin 26 toward the first end 20 of the shaft 18. A spring 36 is positioned about the shaft 18 between the sleeve 30 and a structural component 41 of the compressor 16. Preferably, the shaft 18 includes a stop 42 to provide a positive stop for the sleeve 30. For the stop 42, the shaft 18 can include a snap ring groove 44 having a snap ring 46 disposed therein defining the stop 42. The stop 42 can be defined by the step 40 within the shaft 18. Alternatively, in either case, a spring washer 48 is positioned against the stop 42 to buffer contact between the sleeve 30 and the stop 42.

Figure 4:
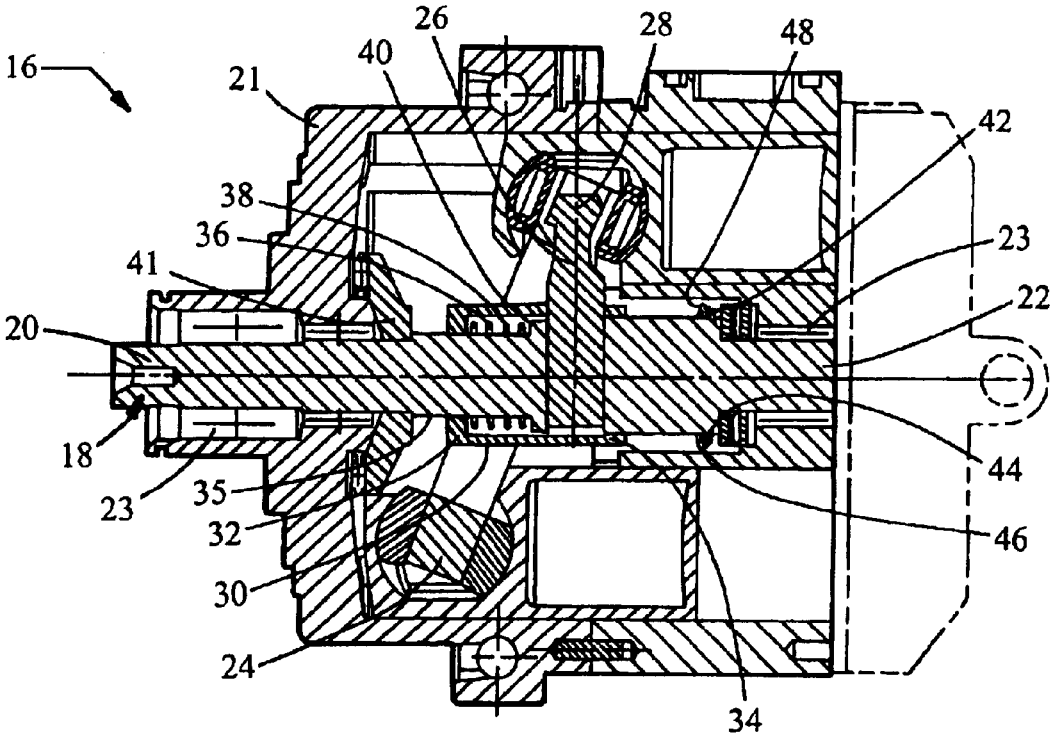
FIG. 4 is a sectional view of a variation of the first preferred embodiment seen in FIG. 3, wherein a spring is positioned within a gap formed between the sleeve and the shaft adjacent the step.

In FIG. 3, the snap ring 46 mounted onto the shaft 18 toward the second end 22 of the shaft 18 defines the stop 42. Additionally, the first collar portion 32 of the sleeve 30 is larger than the second collar portion 34 of the sleeve 30 due to the smaller diameter of the shaft 18 toward the first end 20. This allows the sleeve 30 to slide evenly along the shaft 18 with the step 40 located between the first and second collar portions 32, 34. Referring to FIG. 4, the spring 36 is seen located in an alternate position, within the gap 38 between the first collar portion 32 and the step 40.

Figure 5:
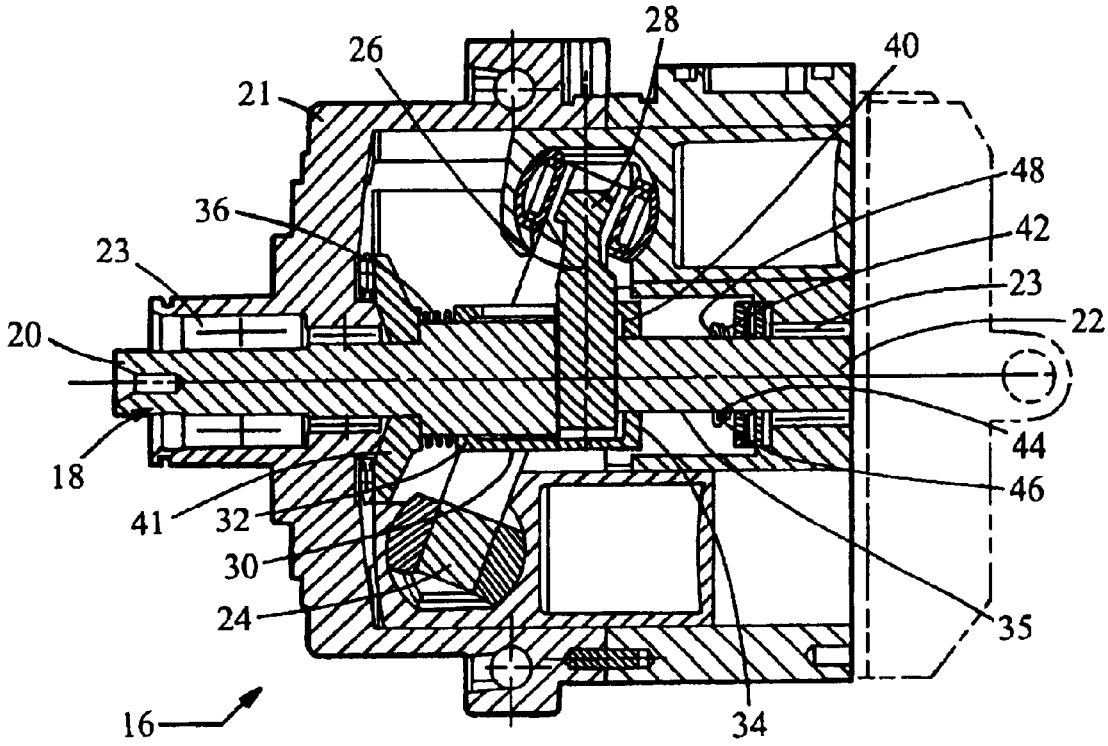
FIG. 5 is a sectional view of another preferred embodiment including a single step.

A second preferred embodiment includes a single step 40 which is adjacent the pin 26 and toward the second end 22 of the shaft 18. Referring to FIG. 5, the spring 36 is positioned between the sleeve 30 and a structural component 41 of the compressor 16 and the stop 42 is provided by a snap ring 46 mounted to the shaft 18 in the reduced diameter portion 35 of the shaft 18. In this construction, the second collar portion 34 of the sleeve 30 is larger than the first collar portion 32 of the sleeve 30 due to the smaller diameter of the shaft 18 toward the second end 20. This allows the sleeve 30 to slide evenly along the shaft 18 with the step 40 located between the first and second collar portions 32, 34.

Figure 6:
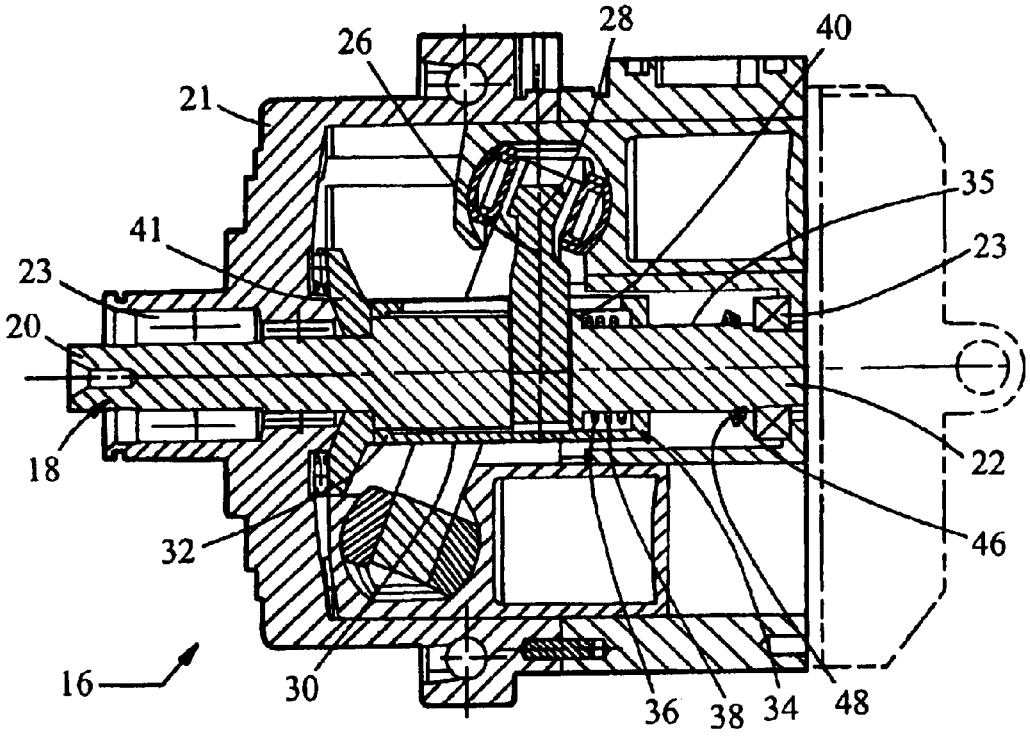
FIG. 6 is a sectional view of a variation of the preferred embodiment seen in FIG. 5 wherein a spring is positioned within a gap formed adjacent the step, between the sleeve and the shaft.

As seen in FIG. 6, the spring 36 is alternatively mounted within the gap 38 between the second collar portion 34 of the sleeve 30 and the step 40.

Figure 7:
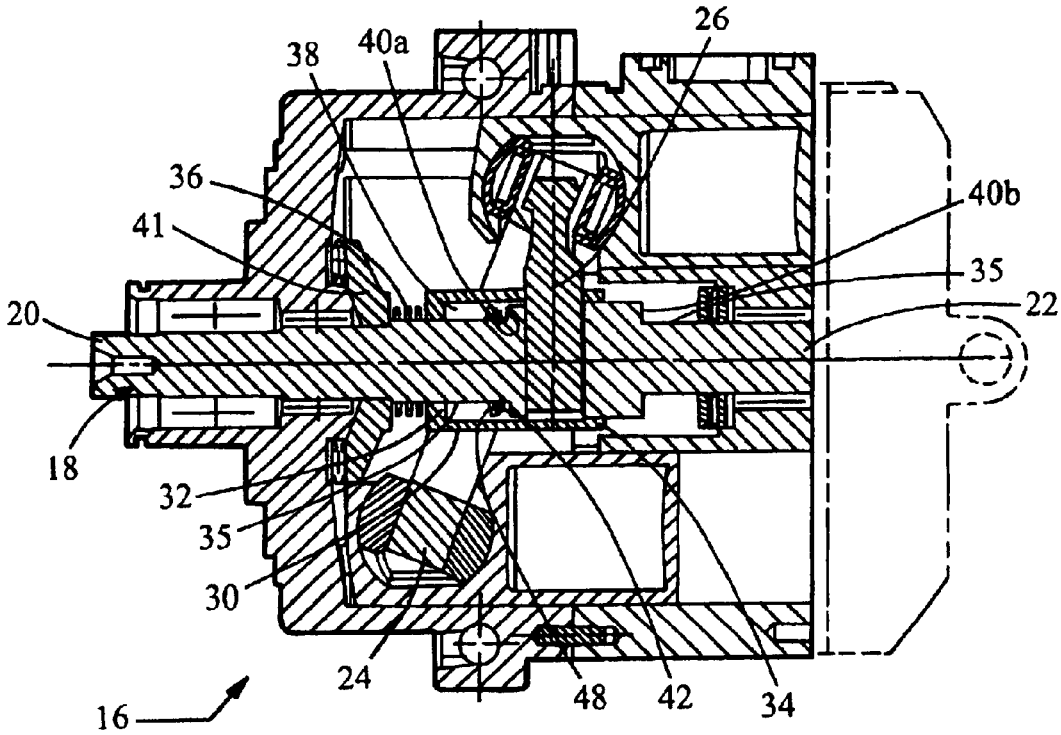
FIG. 7 is a sectional view of yet another preferred embodiment of the present invention wherein the shaft includes a pair of steps.

In another embodiment, the shaft 18 can include a pair of steps 40*a*, 40*b* with one of the steps 40*a*, 40*b* being positioned adjacent the pin 26 and toward each of the first and second ends 20, 22 of the shaft 18. An embodiment of this variety is shown in FIG. 7. The spring 36 is positioned between the sleeve 30 and a structural component 41 of the compressor 16, just as the first preferred embodiment shown in FIG. 3. The stop 42 of this embodiment, however, is defined by the step 40*a* within the shaft 18 and the spring washer 48 rests against the face of the step 40*a*. The length of sleeve 30 is formed such that the second collar portion 34 of the sleeve 30 will not extend beyond the step 40*b* when the sleeve 30 moved. As in prior embodiments first collar portion 32 is larger than the second collar portion 34.

Figure 8:
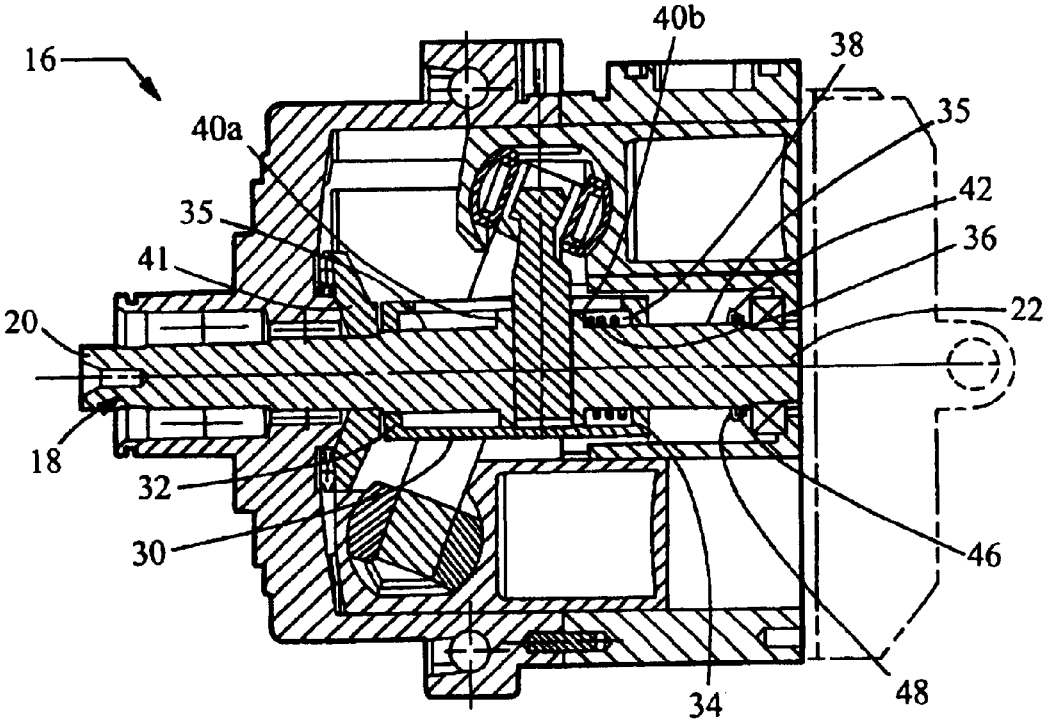
FIG. 8 is a sectional view of a variation of the preferred embodiment seen in FIG. 7 wherein a spring is positioned within a gap formed adjacent the step between the sleeve and the shaft, and the shaft includes a snap ring and a spring washer to provide a positive stop for the sleeve.
Figure 9:
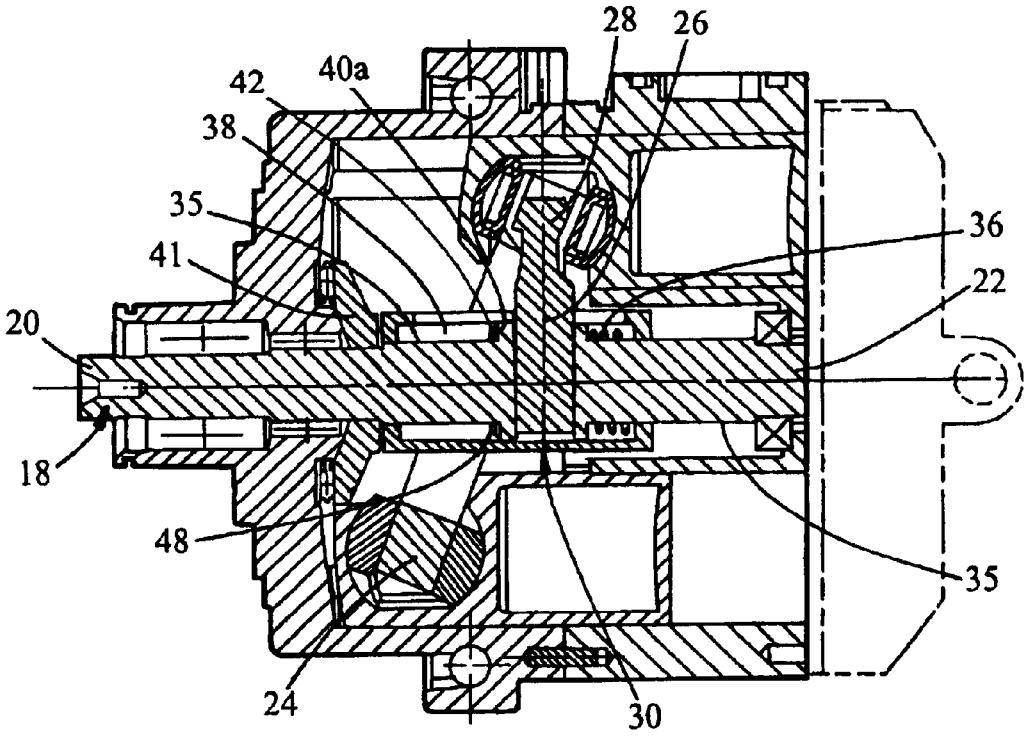
FIG. 9 is a sectional view of another variation, similar to FIG. 8, wherein a spring is positioned within a gap formed adjacent the step, between the sleeve and the shaft and a positive stop is defined by one of the steps.

In a first variation of the embodiment seen in FIG. 7, the second collar portion 34 does extend beyond the step 40*b*, therefore the second collar portion 34 also has a size to allow the sleeve 30 to slide along the smaller diameter shaft 18, as shown in FIG. 8. The spring 36 in this variation is placed within the gap 38 between the step 40*b* and the second collar portion 34. The stop 42 is defined by a snap ring 46 with a spring washer 48 adjacent thereto. The stop 42 could also be defined by the step 40*a* toward the first end 20 as shown in FIG. 9.

Figure 10:
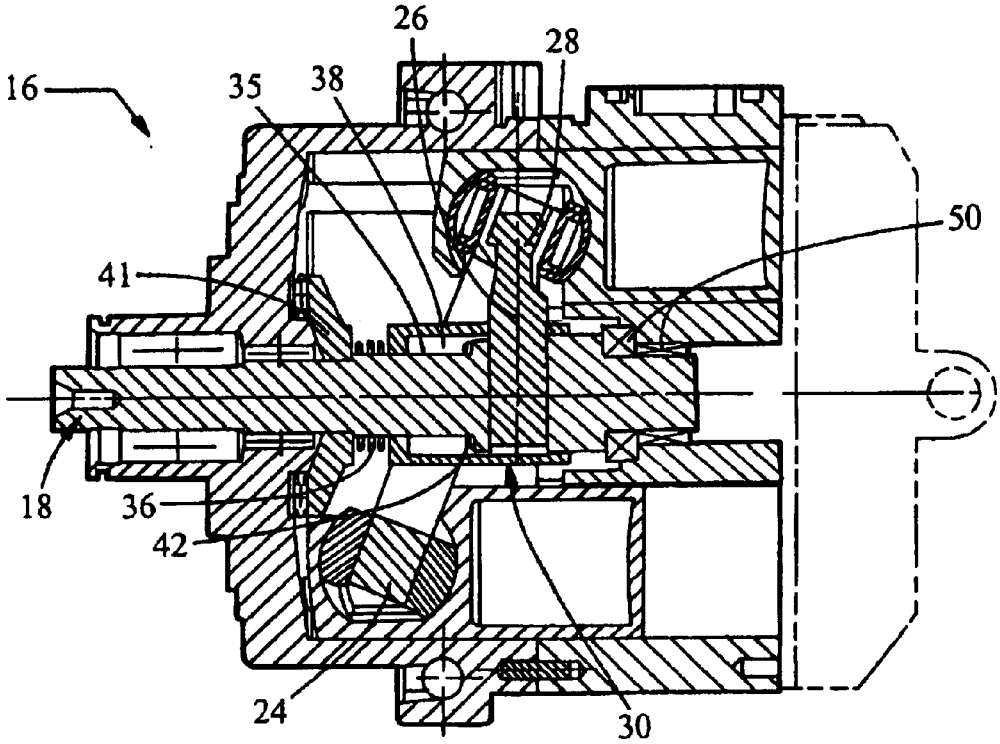
FIG. 10 is a sectional view of a preferred embodiment having a shortened shafts.
Figure 11:
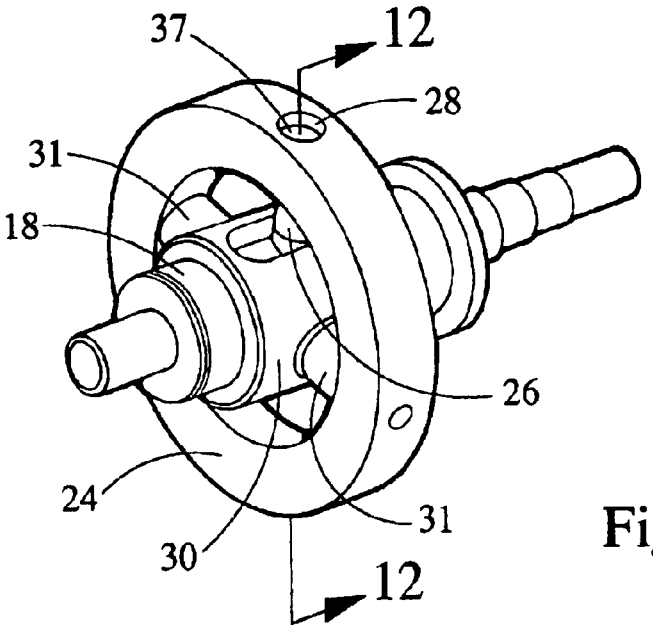
FIG. 11 is a perspective view of a shaft and swash-ring of the present invention.
Figure 12:
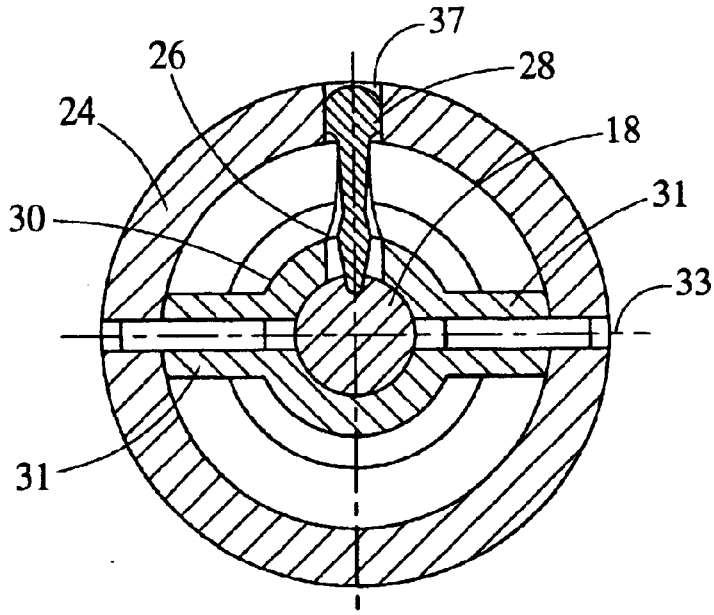
FIG. 12 is a sectional view taken along line 12—12 of FIG. 11.

FIG. 10 illustrates a further embodiment wherein the bearings 50 which support the shaft 18 within the compressor 16 are moved toward the pin 26 such that the overall length of the shaft 18 can be reduced. This configuration having a shortened shaft 18 could be utilized with any of the previously discussed preferred embodiments.

The foregoing discussion discloses and describes three preferred embodiments, and variations thereof, of the present invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

What is claimed is:

1. A variable displacement compressor comprising;

a housing;

a shaft supported within said housing for rotational movement about an axis running longitudinally therethrough, said shaft including a step defining a reduced diameter portion along said shaft;

a pin extending generally outward from said shaft and including a distal end, said step being formed within said shaft adjacent said pin;

a sleeve mounted about said shaft, said sleeve being slidable along said shaft and rotatable with said shaft, said sleeve extending over said step and defining a radial gap between said sleeve and said reduced diameter portion of said shaft;

a swash-ring pivotally supported on said sleeve by a pair of bearing pins, said bearing pins being axially aligned with one another and extending radially outward from diametrically opposed sides of said sleeve and pivotally engaging said swash-ring wherein said swash-ring is pivotable about an axis running longitudinally through said bearing pins and through said shaft, said swash-ring being rotatable with said shaft and further including a radially inwardly open pocket, said distal end of said pin being pivotally received within said pocket, said swash-ring further defining an angle with respect to said longitudinal axis of said shaft, said angle being adjustable with respect to said axis;

a piston supported within said housing, said piston coupled to said swash-ring whereby rotation of said swash-ring causes reciprocating axial movement of said piston; and a biasing member engaging said sleeve and biasing said sleeve along said shaft.

2. The variable displacement compressor of claim 1 wherein said biasing member is positioned between said sleeve and a structural portion of said compressor.

3. The variable displacement compressor of claim 1 wherein said biasing member is positioned within said gap.

4. The variable displacement compressor of claim 1 wherein said biasing member is a spring.

5. The variable displacement compressor of claim 2 wherein said shaft includes a pair of steps, one of said steps being located adjacent said pin toward each of a first end and a second end of said shaft.

6. The variable displacement compressor of claim 4 wherein said shaft includes a stop to provide a positive stop for said sleeve.

7. The variable displacement compressor of claim 6 wherein said stop is defined by said step.

8. The variable displacement compressor of claim 6 wherein said shaft includes a groove, said stop being defined by a snap ring engaged within said groove.

9. The variable displacement compressor of claim 6 further including a spring washer positioned against said stop.

10. A variable displacement compressor comprising;

a housing;

a shaft supported within said housing for rotational movement about an axis, said shaft including a pair of steps defining a reduced diameter portion along said shaft;

a pin extending generally outward from said shaft and including a distal end, one of said steps being formed within said shaft adjacent said pin on each side of said pin;

a sleeve mounted about said shaft, said sleeve being slidable along said shaft and rotatable with said shaft, said sleeve extending over at least one of said steps and defining a radial gap between said sleeve and said reduced diameter portion of said shaft;

a swash-ring pivotally supported on said sleeve by a pair of bearing pins, said bearing pins being axially aligned with one another and extending radially outward from diametrically opposed sides of said sleeve and pivotally engaging said swash-ring wherein said swash-ring is pivotable about an axis running longitudinally through said bearing pins and through said shaft, said swash-ring being rotatable with said shaft and further including a radially inwardly open pocket, said distal end of said pin being pivotally received within said pocket, said swash-ring further defining an angle with said longitudinal axis of said shaft, said angle being adjustable with respect to said axis;

a piston supported within said housing, said piston being coupled to said swash-ring whereby rotation of said swash-ring causes reciprocating axial movement of said piston; and a biasing member engaging said sleeve and biasing said sleeve along said shaft.

11. The variable displacement compressor of claim 10 wherein said biasing member is positioned between said sleeve and a structural portion of said compressor.

12. The variable displacement compressor of claim 10 wherein said biasing member is positioned within said gap.

13. The variable displacement compressor of claim 10 wherein said steps are located adjacent each side of said pin toward each end of said shaft.

14. The variable displacement compressor of claim 10 wherein said shaft includes a stop to provide a positive stop for said sleeve.

15. The variable displacement compressor of claim 14 wherein said stop is defined by said step.

16. The variable displacement compressor of claim 14 wherein said shaft includes a groove, said stop being defined by a snap ring engaged within said groove.

17. The variable displacement compressor of claim 14 further including a spring washer positioned against said stop.

* * * * *